US010068501B2

(12) United States Patent
Conley et al.

(10) Patent No.: US 10,068,501 B2
(45) Date of Patent: Sep. 4, 2018

(54) MODULAR LIGHT MERCHANDISING SYSTEM

(71) Applicant: Hudson & Broad, Inc., New York, NY (US)

(72) Inventors: Thomas Conley, Sherman, CT (US); James Maharg, Sherman, CT (US)

(73) Assignee: Hudson & Broad, Inc., New York, NY (US)

( * ) Notice: Subject to any disclaimer, the term of this patent is extended or adjusted under 35 U.S.C. 154(b) by 273 days.

(21) Appl. No.: 14/954,385

(22) Filed: Nov. 30, 2015

(65) Prior Publication Data

US 2016/0195224 A1 Jul. 7, 2016

Related U.S. Application Data

(60) Provisional application No. 62/085,635, filed on Nov. 30, 2014.

(51) Int. Cl.

| | |
|---|---|
| ***G09F 13/18*** | (2006.01) |
| ***F21V 33/00*** | (2006.01) |
| ***F21S 2/00*** | (2016.01) |
| ***F21K 9/20*** | (2016.01) |
| ***A47F 11/10*** | (2006.01) |
| *F21V 21/008* | (2006.01) |
| *F21V 23/06* | (2006.01) |
| *F21W 131/405* | (2006.01) |

(Continued)

(52) U.S. Cl.

CPC ..... *G09F 13/18* (2013.01); *A47F 11/10* (2013.01); *F21K 9/20* (2016.08); *F21S 2/00* (2013.01); *F21V 33/00* (2013.01); *A47B 2220/0077* (2013.01); *F21V 21/005* (2013.01); *F21V 21/008* (2013.01); *F21V 23/06* (2013.01); *F21W 2131/405* (2013.01); *F21Y 2103/00* (2013.01); *F21Y 2107/30* (2016.08); *F21Y 2115/10* (2016.08)

(58) Field of Classification Search

CPC .. G09F 13/18; F21K 9/20; A47F 11/10; F21S 33/00

See application file for complete search history.

(56) References Cited

U.S. PATENT DOCUMENTS 5,564,950 A 10/1996 Loman et al.
6,582,096 B1 * 6/2003 Searer ..... A47B 61/003 211/105.1

(Continued)

*Primary Examiner* — Anabel Ton

(74) *Attorney, Agent, or Firm* — Ohlandt, Greeley, Ruggiero & Perle, L.L.P.

(57) ABSTRACT

A system for displaying and illuminating goods comprises at least one light tube; an electrical connection to a source of electrical energy for illuminating the at least one light tube; and a mechanical arrangement for supporting the light tube so that the light tube provides support for a product to be displayed. A plurality of light tubes can be connected with at least one joiner for joining the light tubes end to end; at least one electrical connection to a source of electrical energy for illuminating at least a first one of the light tubes; and at least one electrical connector for carrying electrical energy between the first one of the light tubes and a second one of the light tubes. Goods are displayed by placing them on goods hangers associated with the light tubes, or on shelves between adjacent light tubes. A low voltage power supply can be used.

26 Claims, 22 Drawing Sheets

(51) Int. Cl.

| | |
|---|---|
| *F21Y 115/10* | (2016.01) |
| *F21V 21/005* | (2006.01) |
| *F21Y 103/00* | (2016.01) |
| *F21Y 107/30* | (2016.01) |

(56) References Cited

U.S. PATENT DOCUMENTS

| | | | | |
|---|---|---|---|---|
| 6,966,396 | B2 * | 11/2005 | Forsyth | B60K 17/34 180/249 |
| 7,029,312 | B2 | 4/2006 | Reid | |
| 7,278,874 | B2 | 10/2007 | Reid | |
| 7,407,404 | B2 | 8/2008 | Reid | |
| 2004/0070969 | A1 * | 4/2004 | Ward | A47F 7/19 362/223 |
| 2004/0257802 | A1 * | 12/2004 | Helenowski | A47B 61/003 362/217.08 |
| 2008/0259615 | A1 * | 10/2008 | Chien | F21S 8/035 362/382 |
| 2009/0016046 | A1 * | 1/2009 | Witsenburg | A47F 11/10 362/145 |

* cited by examiner

MODULAR LIGHT MERCHANDISING SYSTEM

This application claims priority from and the benefit of provisional application Ser. No. 62/085,635 filed on Nov. 30, 2014, which is incorporated herein for all purposes, in its entirety.

BACKGROUND OF THE DISCLOSURE

1. Field of the Disclosure

The present disclosure relates to modular light merchandising systems, which can be used for, among other uses, displaying goods to be sold. More particularly, it relates to a modular light system having components that can both support and illuminate the goods, and for doing so in a decorative and esthetically pleasing manner.

2. Description of the Related Art

Tubular lights generally, and those illuminated using light emitting diodes (LEDs), are commonly used in various environments, both commercial and residential. However, there are limitations on their usage and effectiveness, particularly in the area of display. For example, current LED tubes are hardwired, with the sole purpose of illumination. They do not offer merchandising capabilities.

SUMMARY OF THE DISCLOSURE

In order to overcome the current drawbacks, in general, embodiments of the disclosure are directed to a modular system including modular interconnects that allow for the almost limitless ability to create structures of light for merchandising in a multitude of shapes, lengths, and orientations.

In a first aspect, the disclosure is directed to a system for displaying and illuminating goods, comprising at least one light tube; an electrical connection to a source of electrical energy for illuminating the at least one light tube; and a mechanical arrangement for supporting the light tube so that the light tube provides support for a product to be displayed.

The at least one light tube can comprise a tube; a first end cap at a first end of the tube and a second end cap at a second end of the tube; a support member extending from the first end cap to the second end cap; and a plurality of light emitting devices affixed to the support member.

The electrical connection comprises an electrical connector, and wherein the electrical connector is located at one of the first end cap and the second end cap, further comprising wiring for electrically connecting the electrical connector to the electrical conductors of the support member.

The support member is a four sided tube having the light emitting devices affixed to each of the sides. It can also be a four sided circuit board, the circuit board having electrical conductors for bringing electrical energy to the light emitting devices.

The system can further comprise an additional electrical connector located at a second one of the first end cap and the second end cap, the additional electrical connector being a connection for providing electrical energy to at least one additional light tube. An electrical cable electrically connects the additional electrical connector to an electrical connector of the at least one additional light tube.

Each light tube can comprise a tube; a first end cap at a first end of the tube and a second end cap at a second end of the tube, each end cap having an opening for receiving a mechanical connection component to connect the light tube to an end cap of an additional light tube.

The system can further comprise a power supply for the light emitting devices, and a power cable for connecting the power supply to the electrical connection.

The light emitting devices can be are light emitting diodes.

The mechanical arrangement for supporting the light tube can comprise a tripod structure for supporting the light tube vertically with respect to a floor. The system can further comprise at least one additional light tube supported by an additional tripod vertically with respect to the floor; and at least one shelf connected to at least two light tubes to be supported parallel to the floor. At least one rectangular display can be supported between adjacent vertically extending light tubes. The display can receive a poster for advertising goods.

The mechanical arrangement for supporting the light tube can comprise a cable attached to an end cap. The end cap can have an opening for receiving a suspension member, the cable being secured to the suspension member.

The goods to be displayed are suspended from the at least one light tube. The system can comprise goods holders attached along the at least one light tube so that the goods are displayed.

In a second aspect, the disclosure is directed to a system for displaying and illuminating goods, comprising: a plurality of light tubes; at least one joiner for joining the light tubes end to end; at least one electrical connection to a source of electrical energy for illuminating at least a first one of the light tubes; and at least one electrical connector for carrying electrical energy between the first one of the light tubes and a second one of the light tubes.

The system can further comprise a series of joiners, light tubes and electrical connectors arranged so that the light tubes and joiners form a closed loop. The closed loop can be rectangular, triangular or circular.

The system can further comprise a series of joiners, light tubes and electrical connectors arranged so that the light tubes and joiner form a co-linear array. The joiners, light tubes and electrical connectors can be arranged so that a first light tube is perpendicular to a second light tube. Each of the joiners can accept a cable for suspending the system, so that the system can be used to support and display goods.

The system can be assembled using modular components with simple and readily available tools.

The efficient light tubes maintain low energy cost, and operate using low voltage electricity so that code related wiring issues do not arise.

BRIEF DESCRIPTION OF THE DRAWINGS

A component or a feature that is common to more than one drawing is indicated with the same reference number in each of the drawings.

DESCRIPTION OF THE EMBODIMENTS

Figure 1:
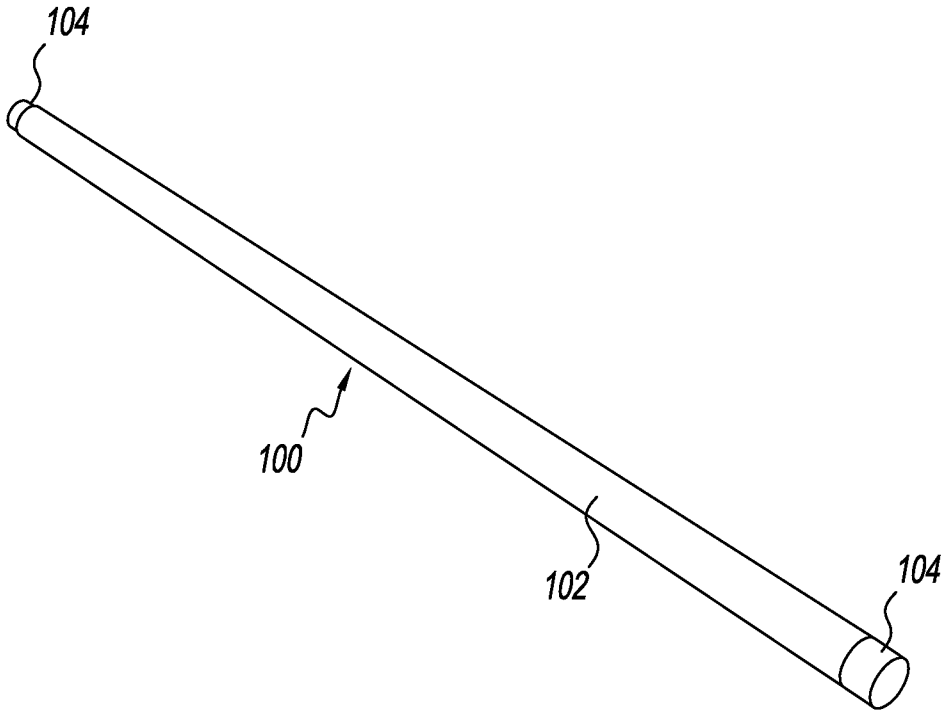
FIG. 1 is a perspective view of a light tube used in a plurality of preferred embodiments.

FIG. 1 illustrates a linear light tube 100 used in various embodiments described below. Light tube 100 includes a translucent structural polymer tube 102 such as a polycarbonate, or other such suitable material. Light tube 100 has end caps 104 as more fully described with respect to FIG. 2 and FIG. 3.

Figure 2:
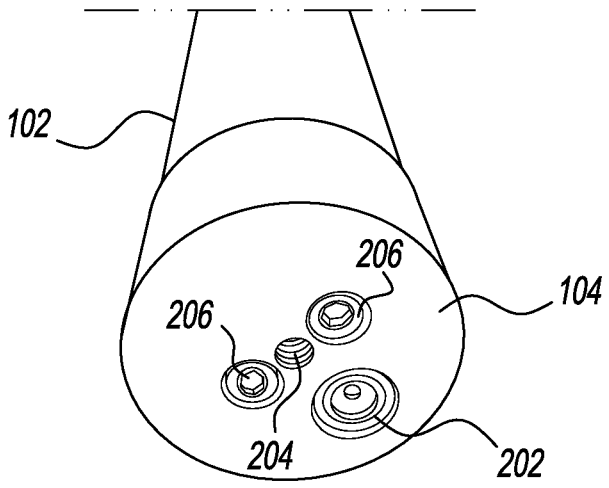
FIG. 2 is a perspective view of an end of the light tube of FIG. 1.

As illustrated in FIG. 2, tube 102 mates at each end with an end cap 104. Each end cap 104 has an opening 202 for receiving an electrical connector, and a threaded opening 204 for receiving a mechanical connection component, as described below.

Figure 3:
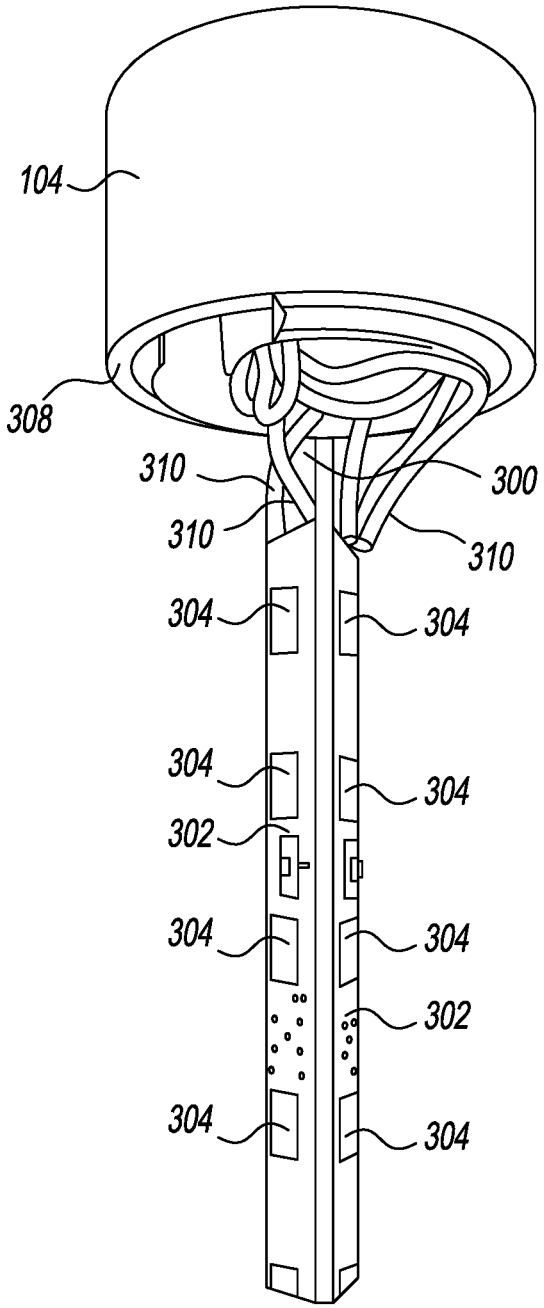
FIG. 3 is a perspective view of an end of the light tube of FIG. 1 illustrating internal components thereof.

As illustrated in FIG. 3, a support member 300 extends along the length of each light tube from a first end cap 104 to a second end cap 104. Support member 300 includes along its length four circuit boards 302 (two shown in FIG. 3) or a four sided circuit board. Each circuit board 302 includes along its length a series of light emitting components 304, which are preferably light emitting diodes (LEDs) for enhanced energy efficiency. A bracket (not visible in FIG. 3), at the end of support member 300 receives two screws (not visible in FIG. 3) which are received in threaded holes (not visible in FIG. 3) in end cap 104 to secure support member 300 to end cap 104. Wires 310, extending from an electrical connector associated with opening 202 provide electrical energy to circuit boards 302 to illuminate the light emitting components 304 thereon.

To assemble light tube 100, support member 300 is inserted into tube 102. One end of tube 102 is received on an annular ledge 308 of end cap 104. Another end cap 104 is then secured to a bracket at the other end of support member 300 by two set screws 206 (FIG. 2), thus securing tube 102 between annular ledges 308 of end caps 104 at each end. The circuit boards 302 and wires 310 provide a path for electrical energy to be carried from one light tube 100 to the next, as more fully described below.

Figure 4:
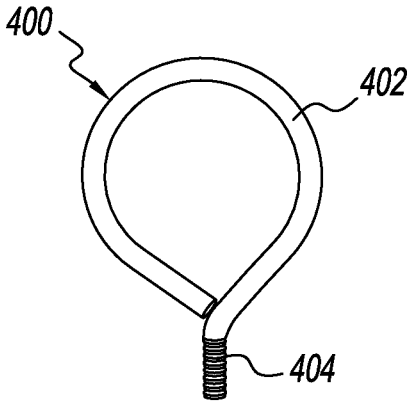
FIG. 4 is a plan view of a suspension hook component that can be assembled to the end of the light tube of FIG. 1.

FIG. 4 illustrates a mechanical connection component 400 in the form of a hook or loop 402 having a threaded end 404 that can be received in opening 204 of end cap 104. Loop 402 can be closed or open, depending on the assembly, as described below, in which it is used.

Figure 5:
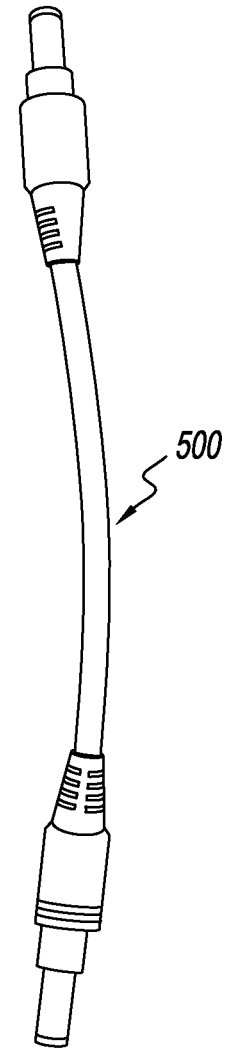
FIG. 5 is a plan view of an electrical connector for connecting a first light tube to a second light tube.

FIG. 5 illustrates an electrical connection cable 500 for connection from one electrical connector associated with an opening 202 in an end cap 104 of a first light tube to an electrical connector associated with an opening 202 in an end cap 104 of a second adjacent light tube.

Figure 6:
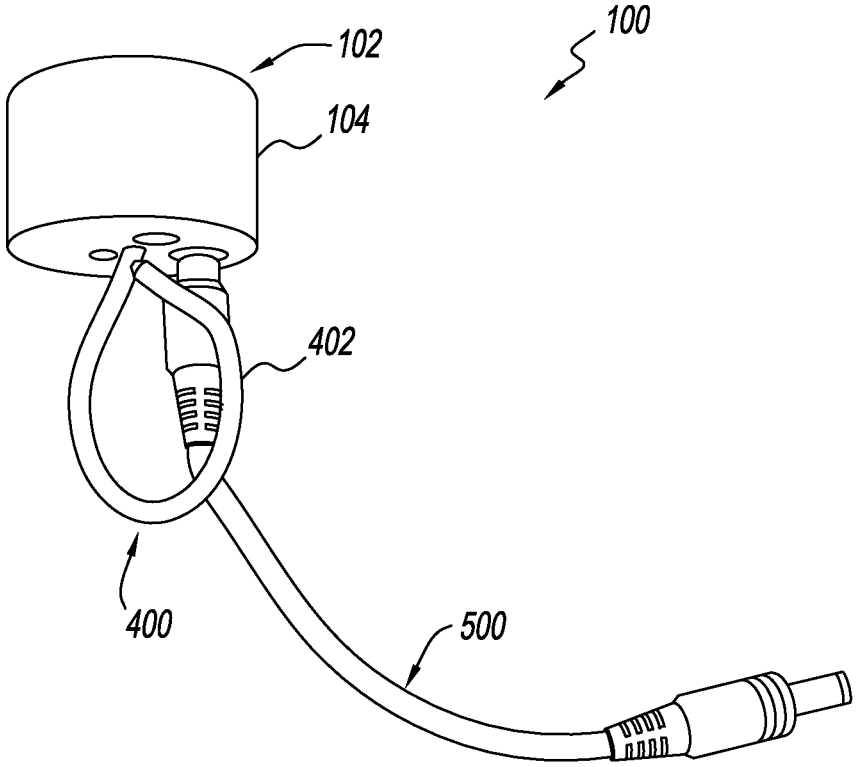
FIG. 6 illustrates the components of FIG. 4 and FIG. 5 assembled to the end of a light tube illustrated in FIG. 1.

FIG. 6 illustrates the assembly of mechanical connection component 400 of FIG. 4 and electrical connection cable 500 of FIG. 5 to an end cap 104 of a light tube 100.

Figure 7:
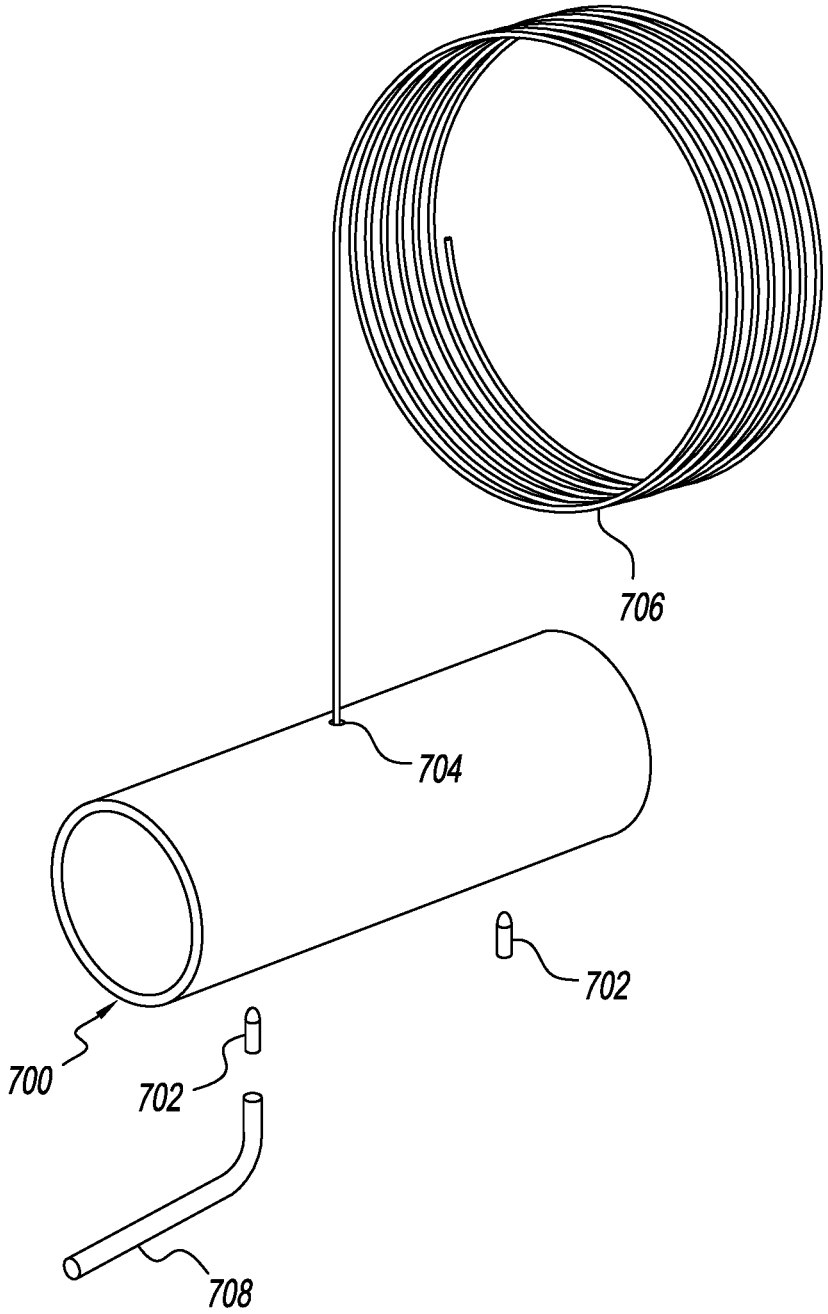
FIG. 7 is a perspective view of a double joiner used to join two light tubes together.

FIG. 7 illustrates a tubular double joiner 700 for mechanically connecting an end cap 104 of a first light tube 100 to an end cap 104 of a second light tube 100. The end caps 104 are closely received in joiner 700 and secured in place, each with at least one set screw 702 received in openings (not shown) in the wall of joiner 700. An opening 704 can receive a flexible member or cable 706, that has a member (not shown) larger than opening 704 so that the member cannot pass through opening 704. Thus, cable 706 can be used to suspend joiner 700 and the light tubes 100 assembled thereto from a ceiling, beam or other structural support to advantageously position the display assemblies as described below. A conventional set screw wrench 708 is used to turn set screws 702 to assemble or disassemble light tubes 100 to joiner 700.

Figure 7A:
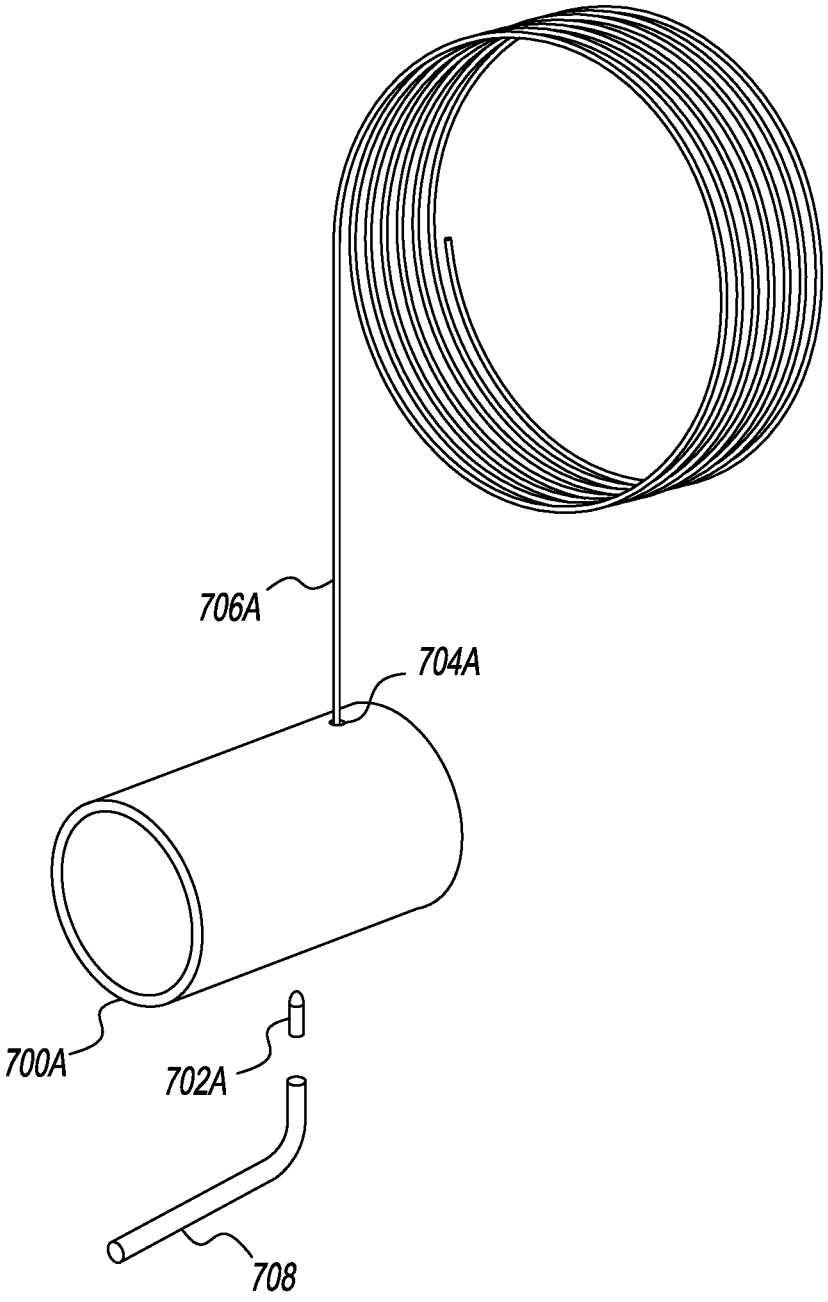
FIG. 7A is a perspective view of a single joiner used to support a single light tube.

FIG. 7A illustrates a single joiner 700A that accepts a single light tube 100. An opening 704A can receive a flexible member or cable 706A, that has a member (not shown) larger than opening 704A so that the member cannot pass through opening 704A. Thus, cable 706A can be used to suspend joiner 700A and the single light tube 100 assembled thereto from a ceiling, beam or other structural support to advantageously position the display assemblies as described below. Again, conventional set screw wrench 708 is used to turn set screw 702A to assemble or disassemble light the light tube 100 to joiner 700A.

Figure 8:
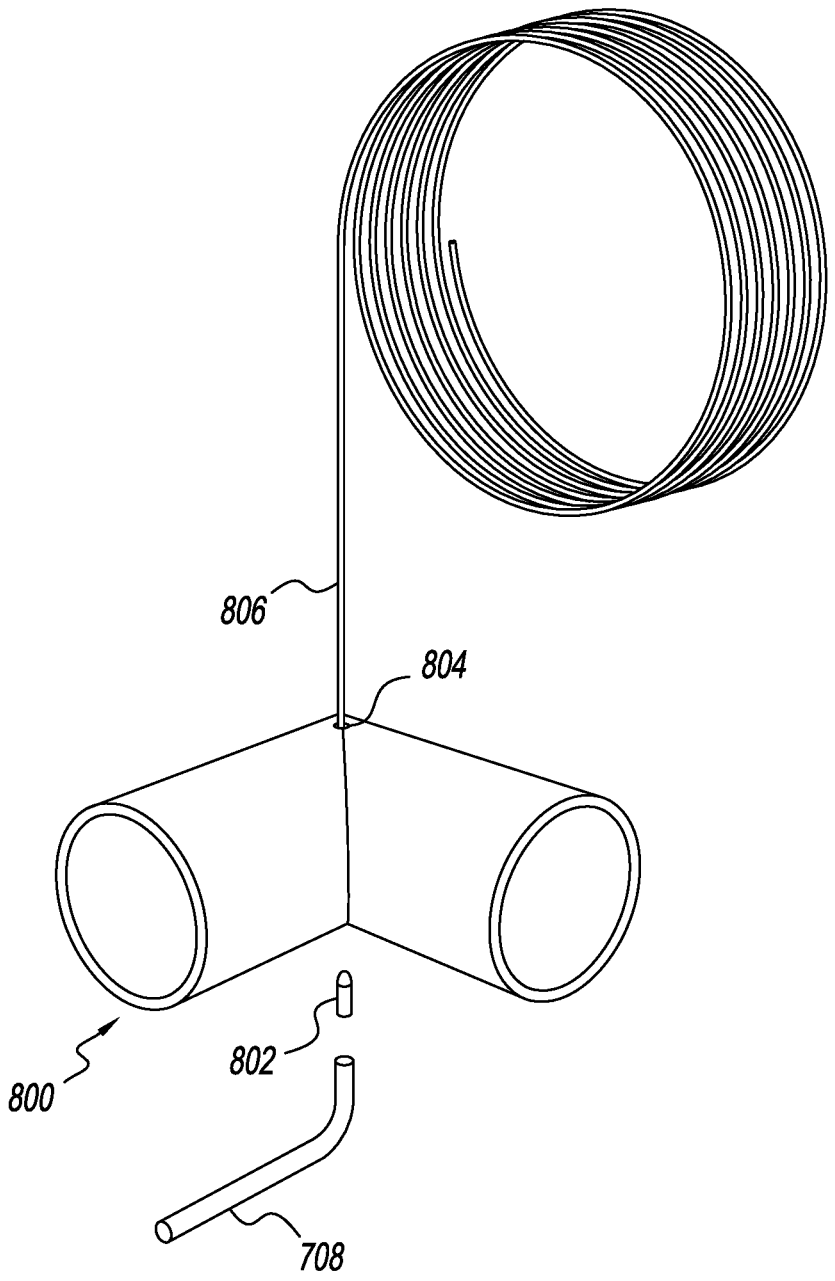
FIG. 8 is a perspective view of a right angle joiner used to join two light tubes together.

FIG. 8 illustrates a right angle joiner 800 for joining two light tubes 100 at right angles to one another. Like component have like reference numerals to those of FIG. 7 and FIG. 7A. While linear and right angle joiners are illustrated, joiners can be constructed in different configurations so as to connect a first light tube 100 to a second light tube 100 at any arbitrary angle.

Figure 8A:
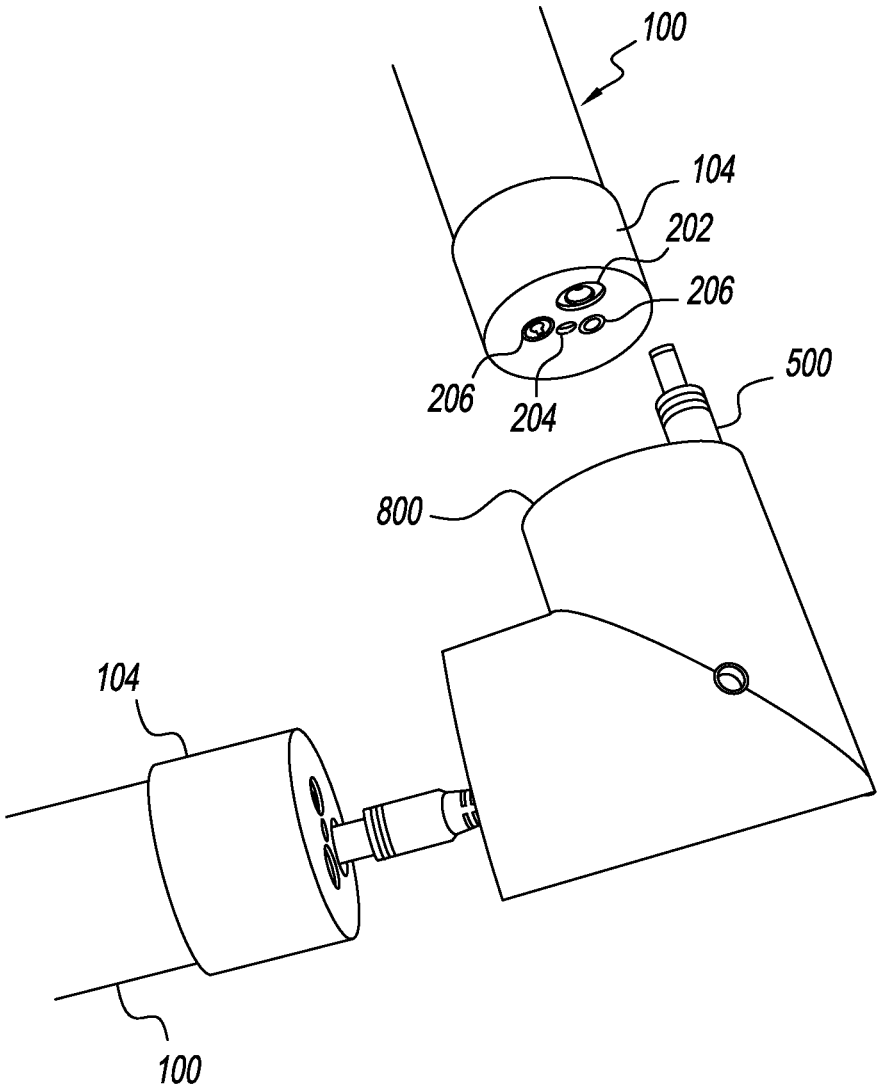
FIG. 8A is an exploded perspective view of the joiner of FIG. 8, also illustrating the end of two light tubes to be joined together and using the electrical connector of FIG. 5.

FIG. 8A illustrates the manner in which a cable 500 of FIG. 5 is received within and plugged into openings 202 of end caps 104 of a first light tube 100 and a second light tube 100 which are being assembled so as to extend at right angles to one another using a joiner 800.

Figure 9:
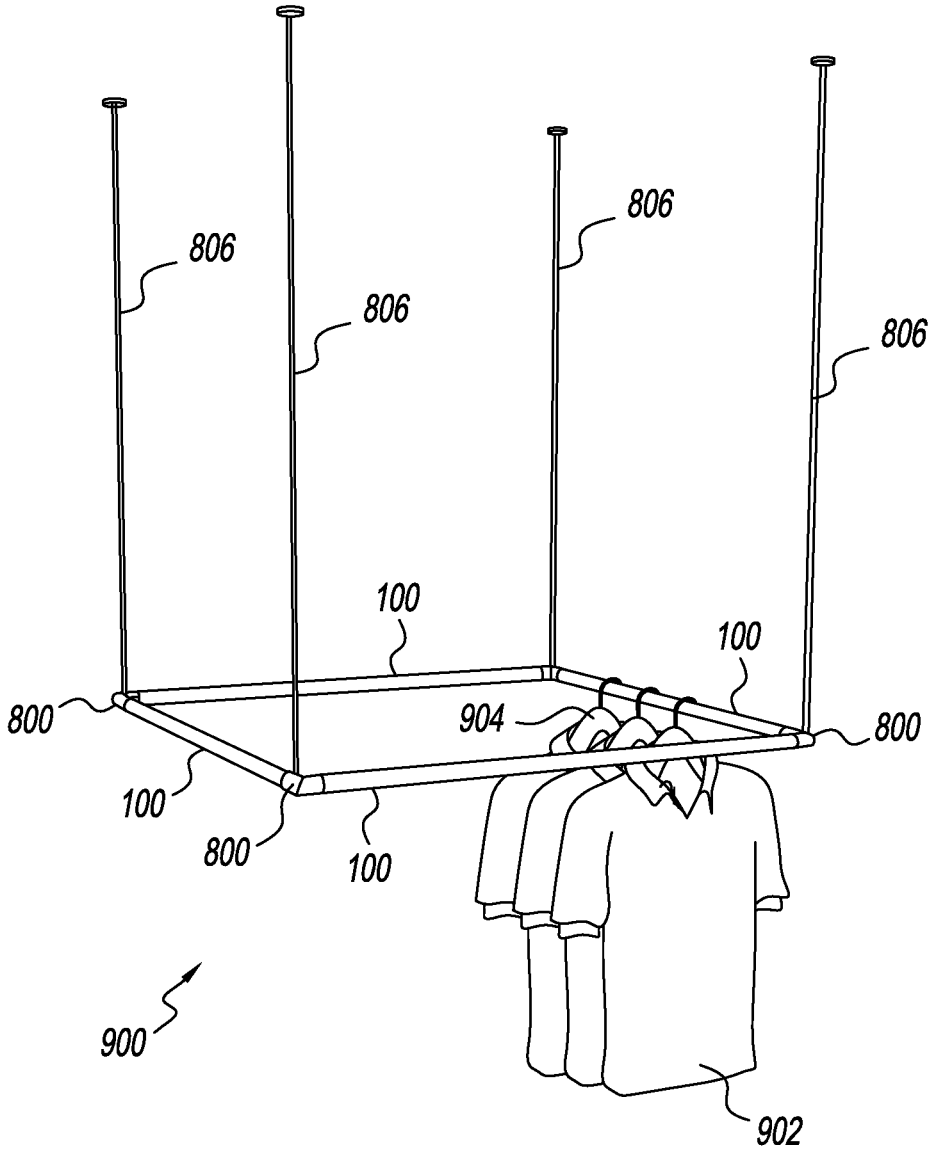
FIG. 9 is a perspective view of a first assembly of four light tubes joined together by four of the joiners of FIG. 8, and suspended from an overhead support.

FIG. 9 illustrates an assembly of four light tubes 100 using four of the right angle joiners 800 of FIG. 8, suspended by four cables 806, to form an illuminated and decorative product display assembly 900. As shown, shirts 902 on hangers 904 can be hung for display to customers on the light tubes 100.

Figure 10:
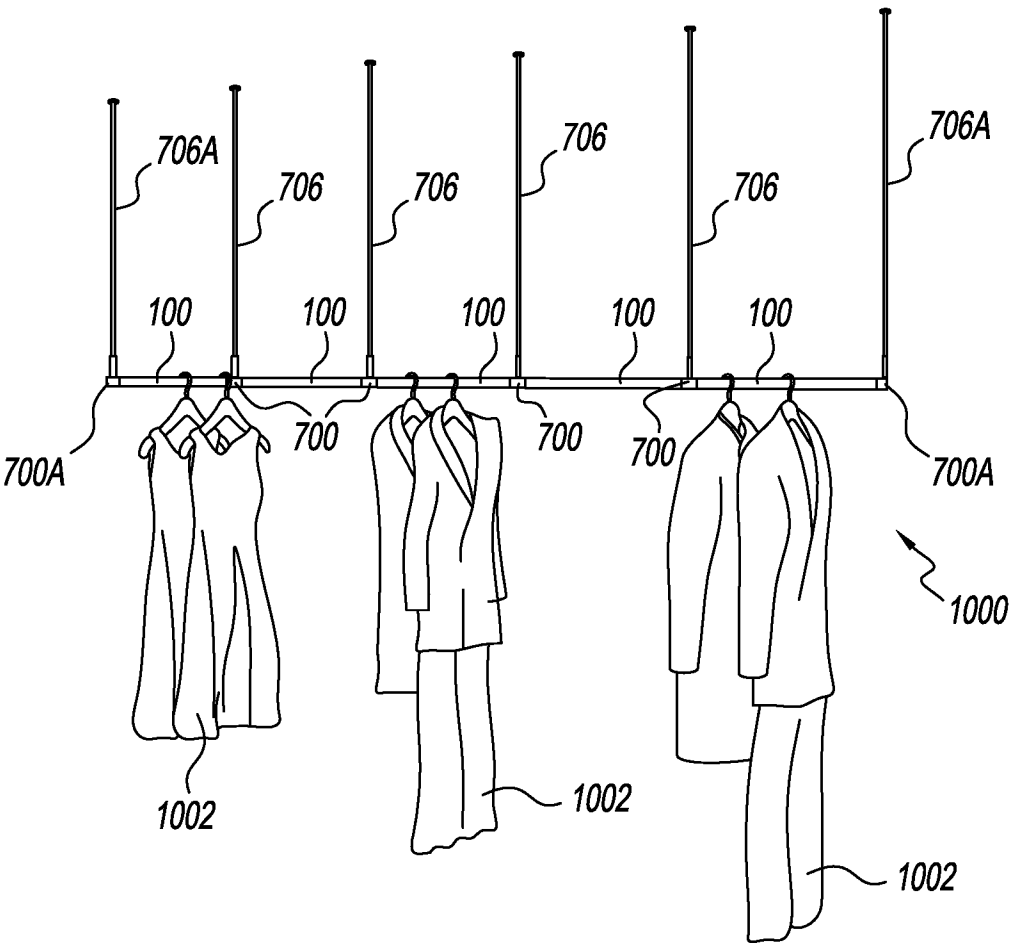
FIG. 10 is a perspective view of a second assembly of light tubes joined together by the joiners of FIG. 7 and FIG. 7A, and suspended from an overhead support.

FIG. 10 illustrates a liner assembly 1000 of light tubes 100, with adjacent light tubes being connected by double joiners 700 and the ends of light tubes 100 not connected to other light tubes connected to joiners 700A. The assembly is suspended by cables 706 and 706A, connected to joiners 700 and 700A respectively. Garments 1002 for display can be on hangers 1004 that are supported by the light tubes 100.

Figure 11:
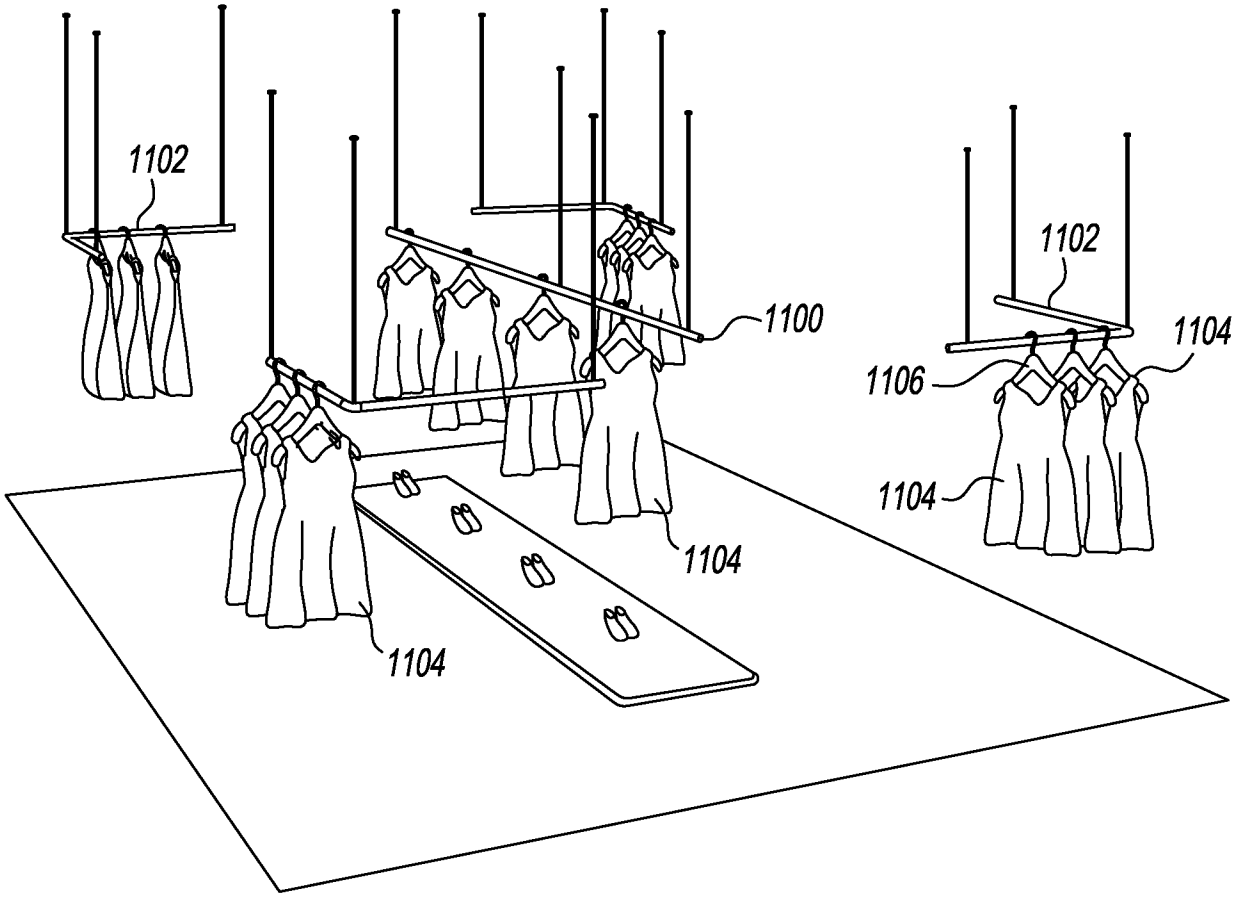
FIG. 11 is a perspective view of a configuration of assemblies of light tubes which form a sales area or shop area for goods being displayed.

FIG. 11 illustrates an arrangement of a set of connected, assembled and suspended light tubes 100 to form a sales area or shop. A linear arrangement 1100 and right angle arrangements 1102 of light tubes are used to illuminate and display garments 1104 on hangers 1106.

Figure 12:
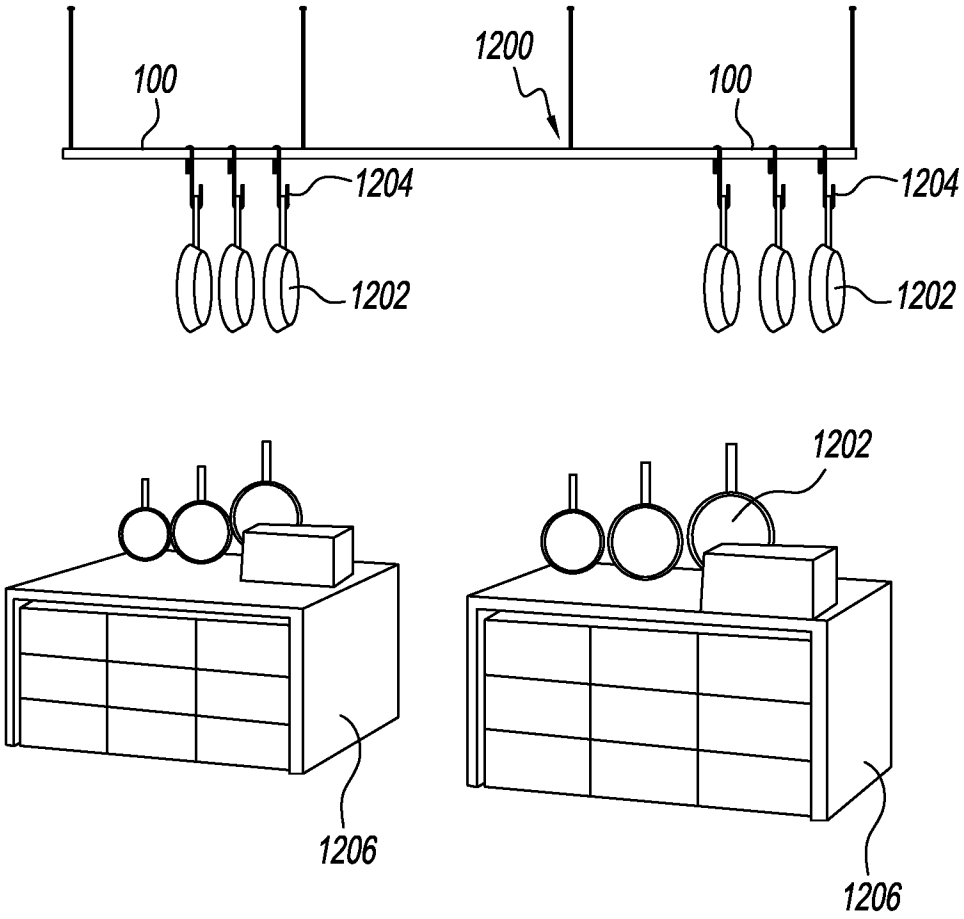
FIG. 12 is a perspective view illustrating a first arrangement for displaying, illuminating and storing goods.

FIG. 12 illustrates a linear arrangement of light tubes 1200 supporting goods to be sold (in this case cooking pans 1202) on hooks 1204 that are suspended from light tubes 100. In this arrangement, storage cabinets 1206 with draws 1208 for the goods being sold are provided.

Figure 13:
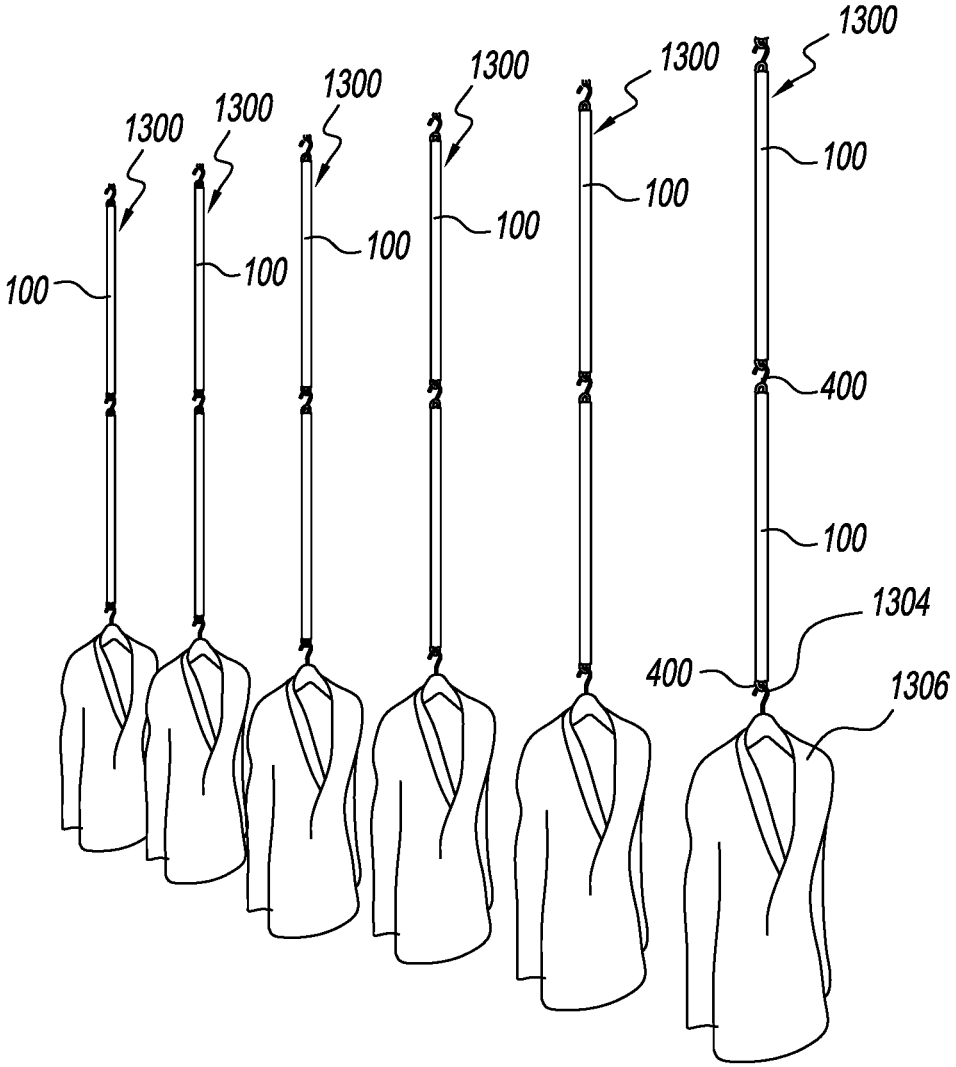
FIG. 13 is a perspective view illustrating a second arrangement for displaying and illuminating goods.

FIG. 13 illustrates a series of vertical assemblies 1300 of two light tubes 100. In each assembly 1300, a first light tube 100 is secured to, for example a ceiling structure by a support device (not shown) that engages a mechanical connection component 400 (FIG. 4) at the top of each uppermost light tube 100. Two interlocked mechanical connection components 400 engage a lower mechanical connection component 400 at the bottom of each uppermost light tube 100 and at the top of each lowermost light tube 100. A mechanical connection component 400 at the bottom of each lowermost light tube 100 provides a convenient opening for inserting the top portion 1304 of a hanger 1304 so that items such as clothing 1306 can be displayed and illuminated.

Figure 14:
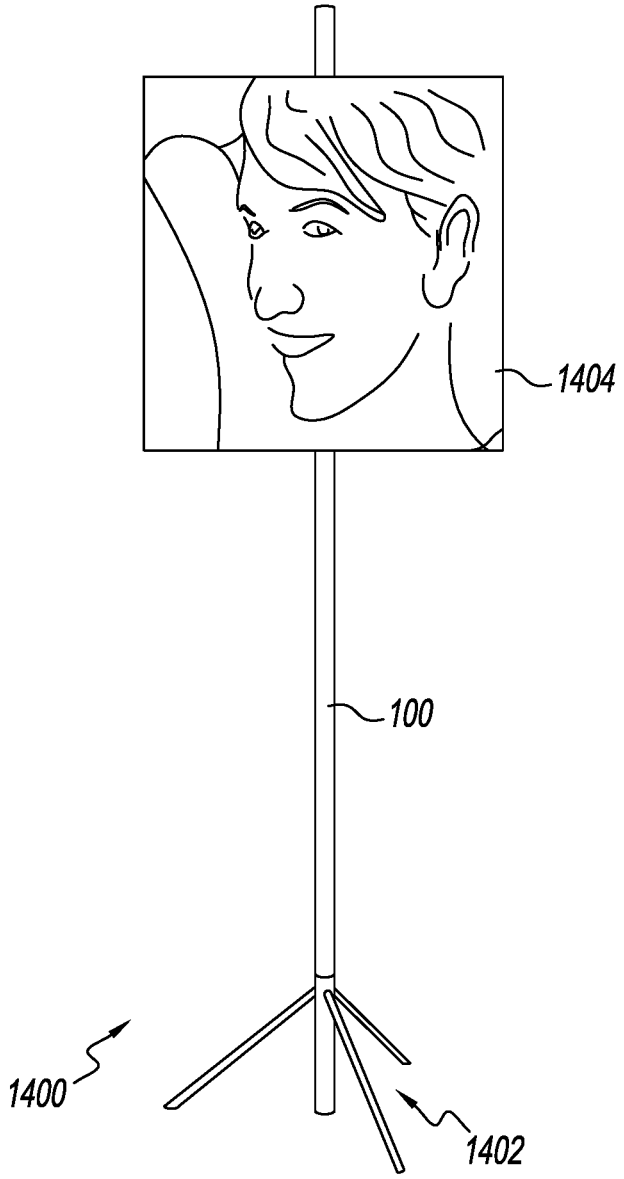
FIG. 14 is a perspective view illustrating a third arrangement for displaying and illuminating goods based on a tripod assembly.

FIG. 14 illustrates an assembly 1400 wherein a light tube 100 is supported vertically in a tripod structure 1402. Assembly 1400 may have any of various holding attachments for securing, generally in a removable manner, a rectangular poster 1404 having at least one of a picture, design or words thereon to assist in the sale of a product.

Figure 15A:
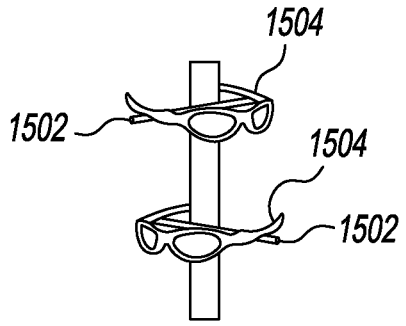
FIG. 15A is an enlarged view of a portion of FIG. 15.
Figure 15:
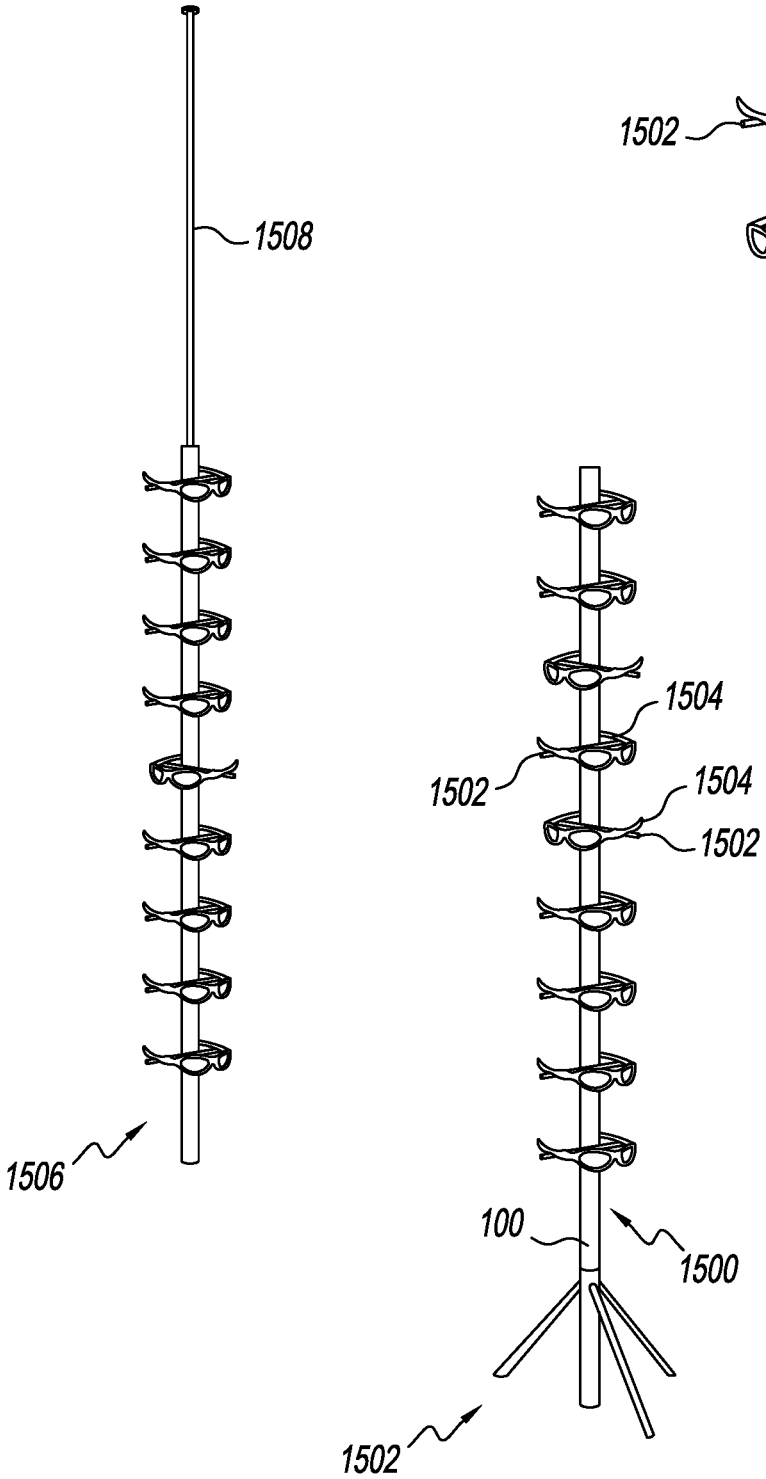
FIG. 15 is a perspective view illustrating a fourth arrangement for displaying and illuminating goods based on a tripod assembly, and supports along the light tube.

In FIG. 15 and FIG. 15A, assembly 1500 is similar to assembly 1400 of FIG. 14, but includes along the length of light tube 100 a series of collars 1502 for supporting goods (in this case glasses 1504 in sunglass holders). Collars 1502 can also be used for attaching or securing various accessories such as signage, graphics, shelving, and faceouts. Assembly 1506 is similar to assembly 1500, but instead of being vertically supported by a tripod structure 1502, assembly 1506 is supported by a cable 1508 attached to a ceiling, support beam or other structure (not shown in FIG. 15).

Figure 16:
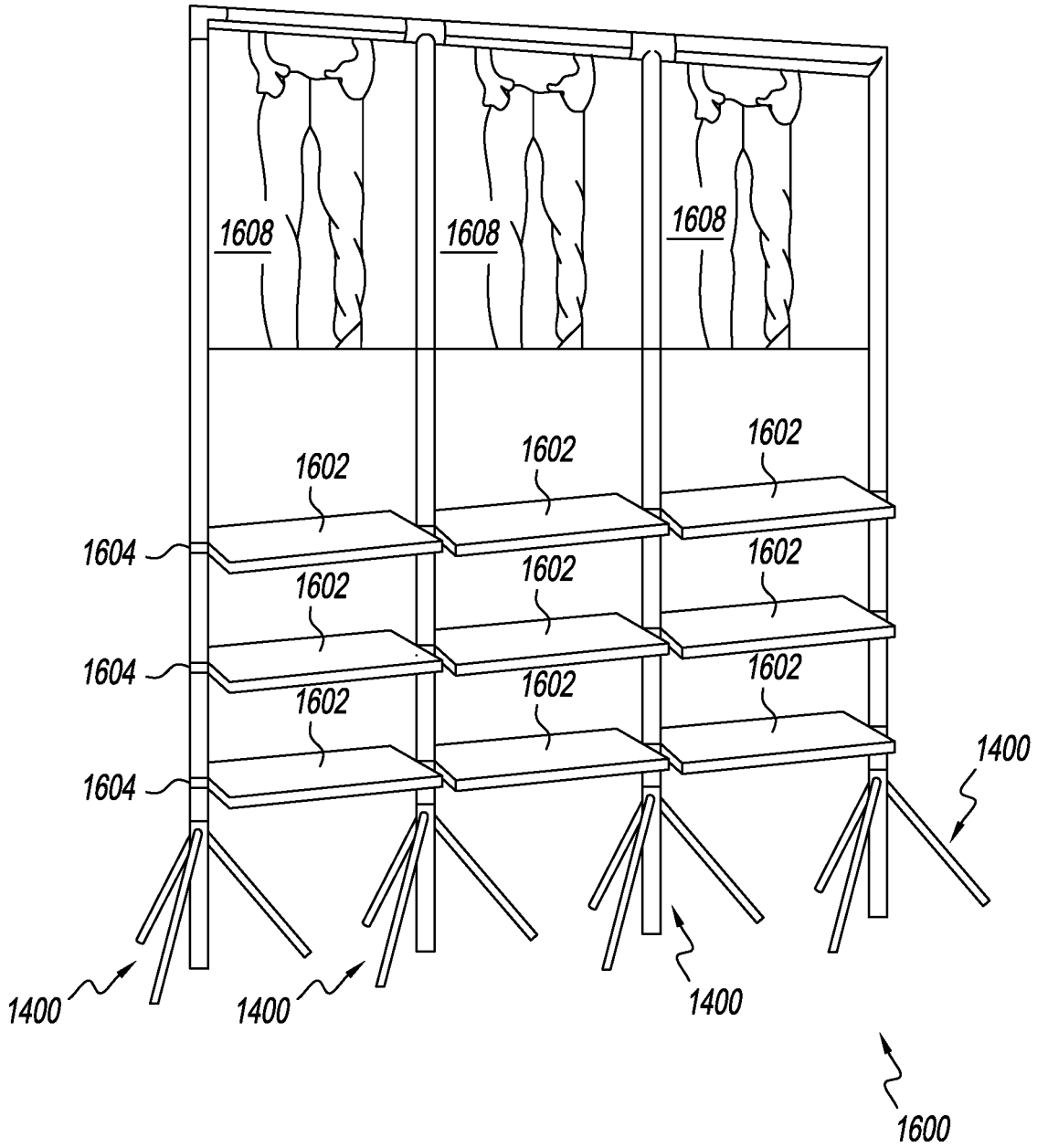
FIG. 16 is a perspective view illustrating a fifth arrangement for displaying and illuminating goods based on a plurality of tripod assemblies, and support shelves.

In FIG. 16, an assembly 1600 used to illuminate and support a product comprises four assemblies 1400 of the type illustrated in FIG. 14 held in spaced parallel relationship by three series of shelves 1602 fastened to respective light tubes 100 by connection collars 1604.

Assembly 1600 may have, as an example, any of various holding attachments, for securing, generally in a removable manner, a series of rectangular posters 1608 having at least one of a picture, design or words thereon to assist in the sale of a product. In the assembly 1600, the poster can be of jeans, and the shelves 1602 can provide a place to store the jeans.

Figure 17A:
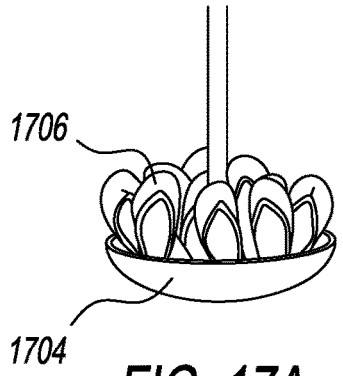
FIG. 17A is an enlarged view of a portion of FIG. 17.
Figure 17:
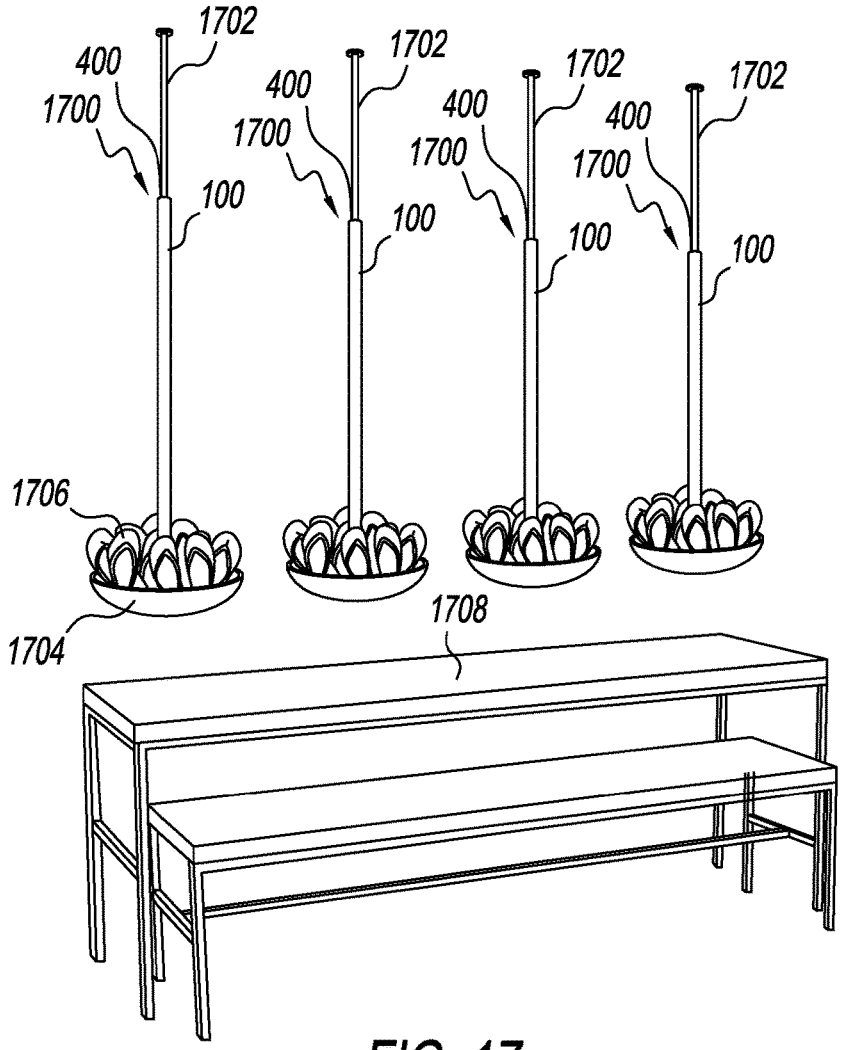
FIG. 17 is a perspective view illustrating a sixth arrangement for displaying and illuminating goods based on a light tube and bowls.

In FIGS. 17 and 17A, a series of assemblies 1700, including light tubes 100, are supported by a mechanical connection component 400 at the top thereof, which is in turn suspended from a ceiling or other structural member by a cable 1702. A bowl 1704 in which goods 1706 are displayed and illuminated is affixed to the lower end cap 104 of each light tube 100. A bench like structure 1708 may be placed in proximity.

Figure 18:
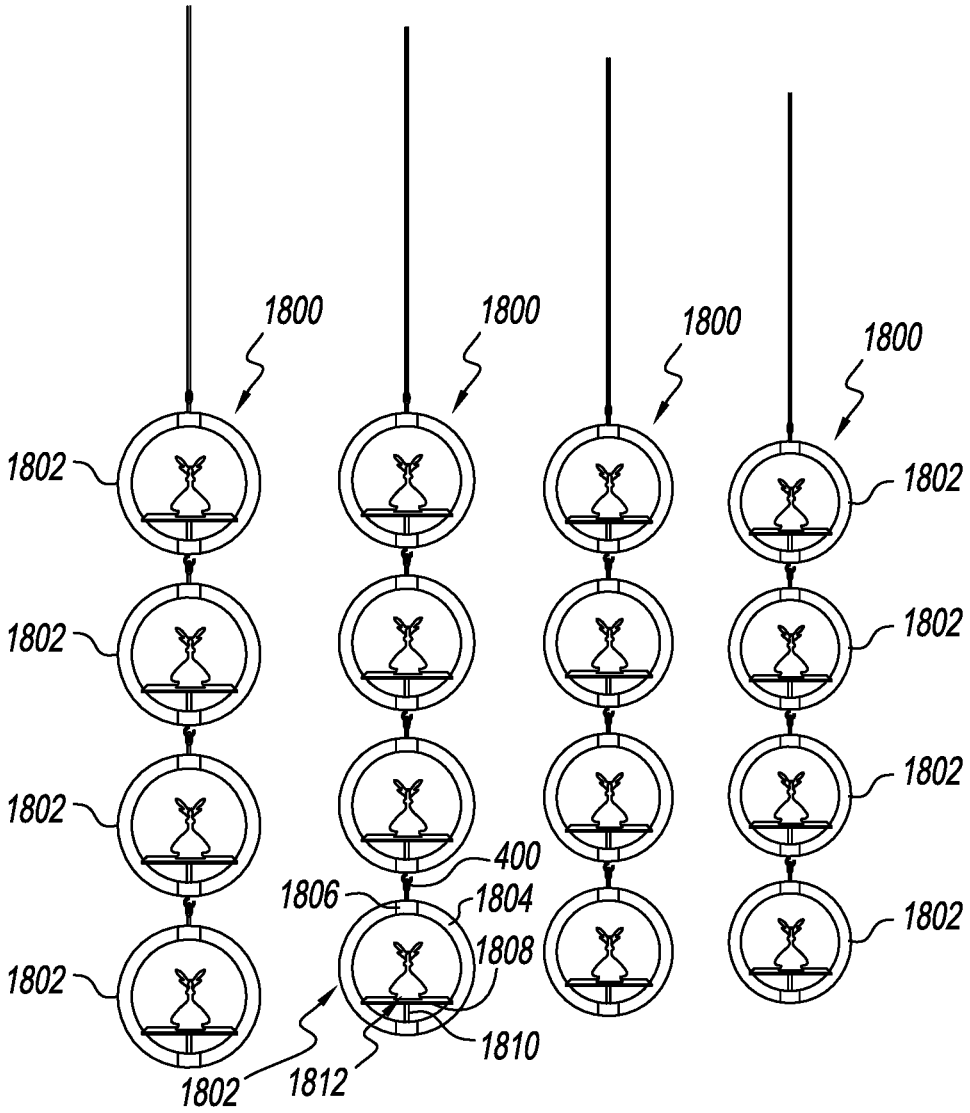
FIG. 18 is a perspective view illustrating a seventh arrangement for displaying and illuminating goods based on circular light tubes.
Figure 18A:
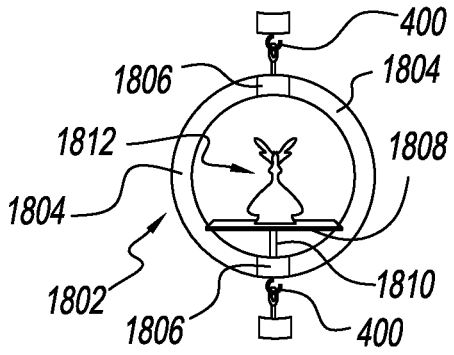
FIG. 18A is an enlarged view of a portion of FIG. 18.
Figure 18B:
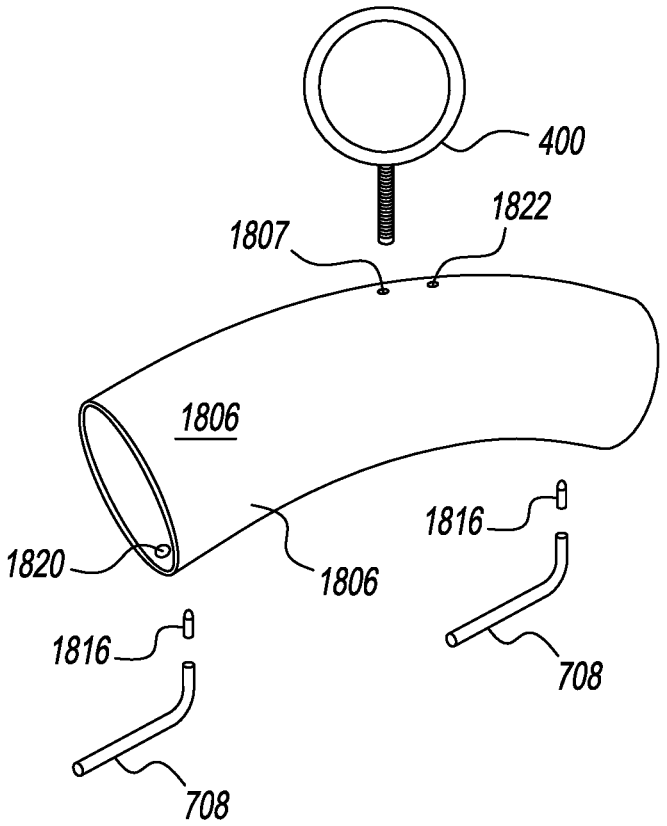
FIG. 18B is an enlarged view of a curved joiner used in FIG. 18 and FIG. 18A.

FIGS. 18, 18A and 18B illustrate a series of assemblies 1800 each comprising four circular light tubes 1802, having, for example (and not by way of limitation) a diameter of sixteen inches. Each circular light tube 1802 includes two generally semicircular tubes 1804 connected by two curved joiners 1806 shown in FIG. 18B. The curved joiners 1806 have threaded opening 1807 therein (similar to threaded openings 204 of end caps 202 of FIG. 2) each for receiving a mechanical connection component 400 to facilitate suspension of assemblies 1800 in a manner similar to that described above with respect to FIG. 13, FIG. 15 and FIG. 17. A platform 1808 is supported by a rod 1810 extending vertically upward from the lower curved joiner 1806 of each circular light tube 1802. The rod may be threaded to be received in an opening 1807 located in the concave side of curved joiner 1806. Goods 1812 to be displayed and illuminated are placed on the platforms 1808.

Ends of semicircular tubes 1804 are inserted into curved joiners 1806 a distance of, for example, one inch, as constrained by internal ridges or projections (not shown). Semicircular tubes 1804 are held in place by set screws 1816, received within respective threaded openings 1820 (only one shown in FIG. 18B). Ends of set screws 1816 are tightened against semicircular tubes 1804 by use of a set screw wrench 708. An opening 1822 associated with a power connector receives a plug of a power cable (FIG. 5 or FIG. 20) for supplying electrical energy to LEDs within semicircular tubes 1804.

Electrical energy is provided to additional circular light tubes 1802 by using a cable such as cable 500 (FIG. 5) between electrical connectors in a lower curved joiner 1806 of a first circular light tube 1802, to an electrical connector in an upper curved joiners 1806 of a second circular light tubes 1802, wherein the second circular light tube is suspended by mechanical connection components 400 below the first circular light tube 1802.

Figure 19A:
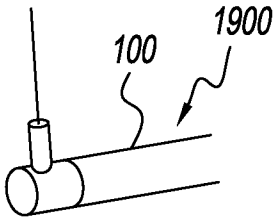
FIG. 19A is an enlarged view of a portion of FIG. 19.
Figure 19:
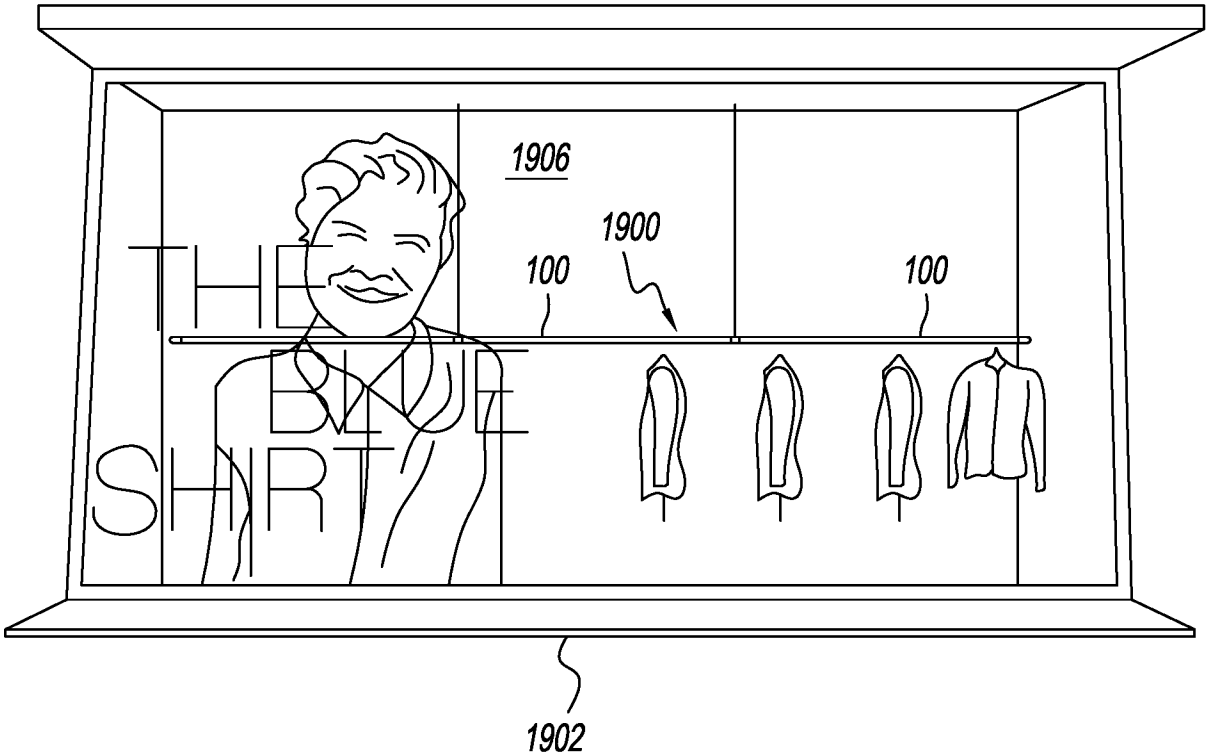
FIG. 19 is a perspective view illustrating an eighth arrangement for displaying and illuminating goods used in a window display.

Referring to FIG. 19 and FIG. 19A, a linear array 1900 of light tubes 100 may be placed in a store window 1902. Goods 1904 to be displayed and illuminated, such as, for example clothing items, are placed on hangers supported by light tubes 100. A poster 1906 having at least one of a picture, design or words thereon to assist in the sale of the product can be placed on an internal wall of window 1902 to facilitate sales, by for example, making the store window more attractive.

Figure 20:
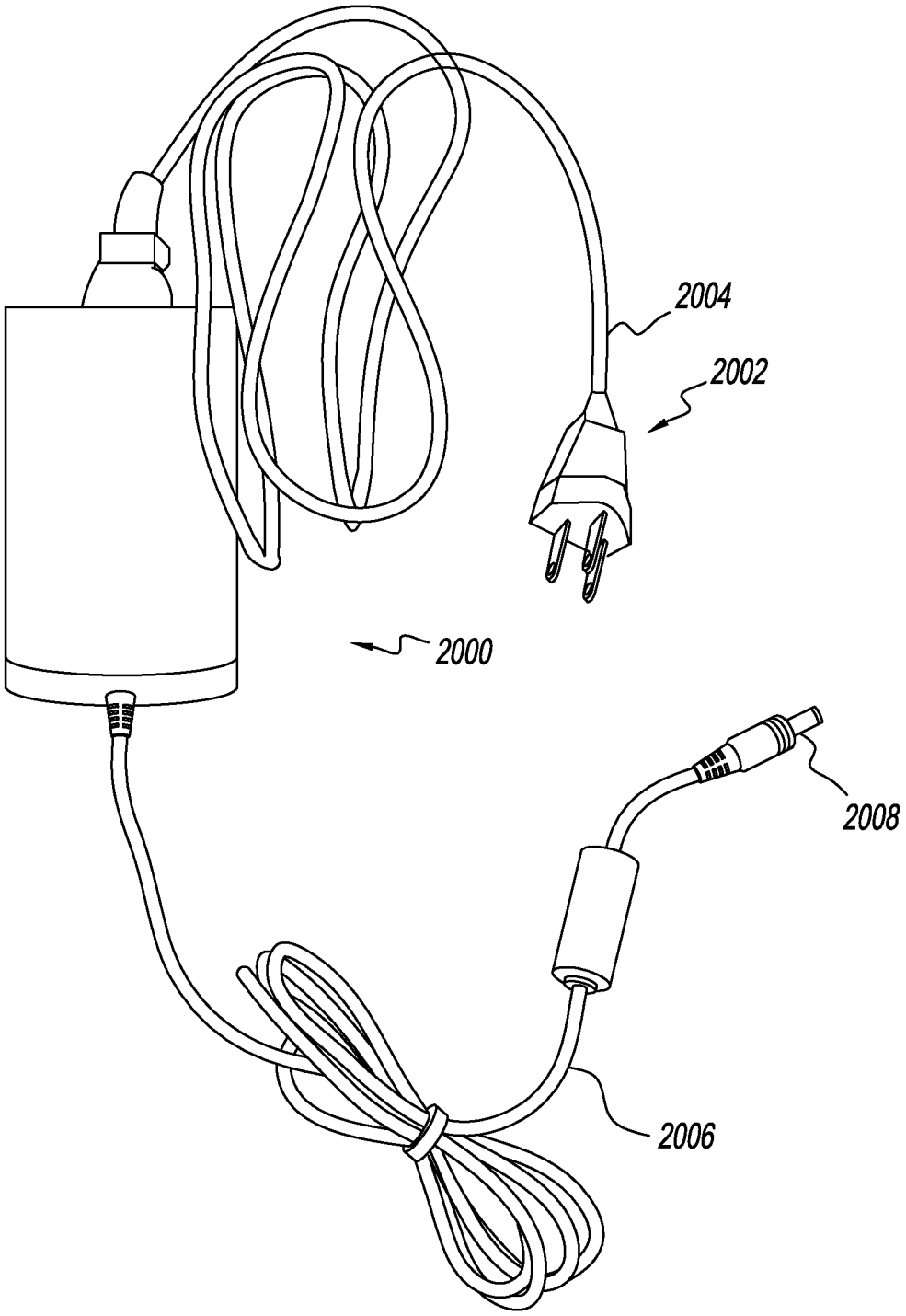
FIG. 20 is a perspective view of a power supply used to provide electrical energy to illuminate the light tubes described above.

FIG. 20 illustrates a low voltage power supply 2000 for the light tubes of the various embodiments described above. A standard three prong power plug 2002, at the end of a standard power cord 2004, is connected to a standard 120 volt wall outlet or extension cord (both not shown) although other standard plugs for different voltages can be used. A low voltage power cord 2006 carries a voltage in the order of approximately 5 volts, to a plug 2008, for connection to an electrical connector associated with an opening 202 in an end cap 104 of a light tube 100. If several light tubes are present, then power is carried from one light tube to the next using the cables 500, as described above with respect to FIGS. 5, 6 and 8A.

Figure 21:
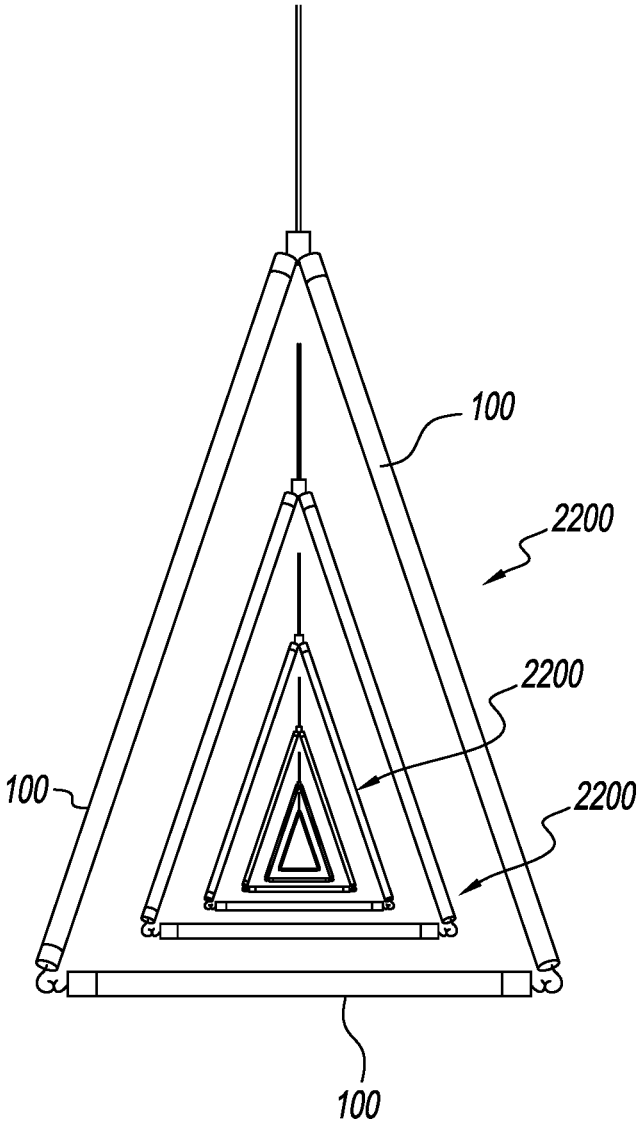
FIG. 21 is a side view of a series of triangular arrangements of light tubes in accordance with the disclosure herein.

FIG. 21 illustrates a series of triangular light assemblies 2200 of light tubes 100. Assembly and suspension of these light assemblies is in accordance with the principles and disclosure set forth above. However, assemblies 2200 are comprised of light tubes 100 of two different lengths, with the bottom or horizontal side of the triangle being of a shorter length. In practice, various lengths of light tubes can be used to form the triangular shape.

The light tubes of any embodiment can provide light of different colors. For example, although the illuminated LEDs can emit white light, the tubes 102 in which the components are disposed can be of various colors as desired for any given application. Hard colored "light gels" can be placed over LEDs emitting white light to provide light of various colors.

As an alternative, LEDs that emit different colors of light can be used. The tubes 102 can be translucent, for better light distribution, and the avoidance of "hot spots". Thus, it is desirable that the tubes 102 be translucent or frosted to better diffuse the light.

While the various embodiments have been directed to arrangements that are very useful in retail store fixtures, other embodiments can be used in hotel closets as illuminated hang rods and in hotel bathrooms as illuminated towel rods and shower curtain rods, comprising variously shaped tubular, generally LED lights with a multiplicity of connectors and interfaces, thereby allowing end users in various fields to configure the lights in a variety of orientations, both linear and three dimensional.

The techniques described herein are exemplary, and should not be construed as implying any particular limitation on the present disclosure. It should be understood that various alternatives, combinations and modifications could be devised by those skilled in the art. The present disclosure is intended to embrace all such alternatives, modifications and variances that fall within the scope of the appended claims.

The terms "comprises" or "comprising" are to be interpreted as specifying the presence of the stated features, integers, steps or components, but not precluding the presence of one or more other features, integers, steps or components or groups thereof.

What is claimed is:

1. A system for displaying and illuminating goods, comprising:

at least one light tube, wherein the at least one light tube comprises:

a tube;

a first end cap at a first end of said tube and a second end cap at a second end of said tube;

a support member extending from said first end cap to said second end cap, wherein said support member is a four sided tube having said light emitting devices affixed to each of said sides; and a plurality of light emitting devices affixed to said support member;

an electrical connection to source of electrical energy for illuminating the at least one light tube; and a mechanical arrangement for supporting the light tube so that the light tube provides support for a product to be displayed.

2. The system of claim 1, wherein the at least one light tube comprises:

a tube;

a first end cap at a first end of said tube and a second end cap at a second end of said tube;

a support member extending from said first end cap to said second end cap; and a plurality of light emitting devices affixed to said support member.

3. The system of claim 1, wherein said electrical connection comprises an electrical connector, and wherein said electrical connector is located at one of the first end cap and the second end cap, further comprising wiring for electrically connecting said electrical connector to said electrical conductors of said support member.

4. The system of claim 2, wherein said support member is a four sided tube having said light emitting devices affixed to each of said sides.

5. A system for displaying and illuminating goods, comprising:

at least one light tube, wherein the at least one light tube comprises:

a tube;

a first end cap at a first end of said tube and a second end cap at a second end of said tube;

a support member extending from said first end cap to said second end cap, wherein said support member is a four sided circuit board; and a plurality of light emitting devices affixed to said circuit board, said circuit board having electrical conductors for bringing electrical energy to said light emitting devices;

an electrical connection to a source of electrical energy for illuminating the at least one light tube; and a mechanical arrangement for supporting the light tube so that the light tube provides support for a product to be displayed.

6. The system of claim 3, further comprising:

an additional electrical connector located at a second one of the first end cap and the second end cap, the additional electrical connector being a connection for providing electrical energy to at least one additional light tube.

7. The system of claim 6, further comprising an electrical cable for electrically connecting said additional electrical connector to an electrical connector of said at least one additional light tube.

8. A system for displaying and illuminating goods, comprising:

at least one light tube, wherein each light tube comprises:

a tube;

a first end cap at a first end of said tube and a second end cap at a second end of said tube, each end cap having an opening for receiving a mechanical connection component to connect said light tube to an end cap of an additional light tube;

an electrical connection to a source of electrical energy for illuminating at least one light tube; and a mechanical arrangement for supporting the light tube sp that the light tube provides support for a product to be displayed.

9. The system of claim 1, further comprising:

a power supply for said light emitting devices, and a power cable for connecting said power supply to said electrical connection.

10. A system for displaying and illuminating goods, comprising:

at least one light tube;

an electrical connection to a source of electrical energy for illuminating the at least one light tube; and a mechanical arrangement for supporting the light tube so that the light tube provides support for a product to be displayed;

wherein said light emitting devices are light emitting diodes.

11. A system for displaying and illuminating goods, comprising:

at least one light tube;

an electrical connection to a source of electrical energy for illuminating the at least one light tube; and a mechanical arrangement for supporting the light tube so that the light tube provides support for a product to be displayed;

wherein the mechanical arrangement for supporting the light tube comprises a tripod structure for supporting the light tube vertically with respect to a floor.

12. The system of claim 11, further comprising:

at least one additional light tube supported by an additional tripod vertically with respect to the floor; and at least one shelf connected to at least two light tubes to be supported parallel to the floor.

13. The system of claim 12, further comprising at least one rectangular display supported between adjacent vertically extending light tubes.

14. The system of claim 13, wherein the display receives a poster for advertising goods.

15. A system for displaying and illuminating goods, comprising:

at least one light tube;

an electrical connection to a source of electrical energy for illuminating the at least one light tube; and a mechanical arrangement for supporting the light tube so that the light tube provides support for a product to be displayed;

wherein the light tubes comprise an end cap, and the mechanical arrangement for supporting the light tube comprises a cable attached to the end cap.

16. A system for displaying and illuminating goods, comprising:

at least one light tube;

an electrical connection to a source of electrical energy for illuminating the at least one light tube; and mechanical arrangement for supporting the light tube so that the light tube provides support for a product to be displayed;

wherein the end cap has an opening for receiving a suspension member, the cable being secured to the suspension member.

17. A system for displaying and illuminating goods, comprising:

at least one light tube;

an electrical connection to a source of electrical energy for illuminating the at least one light tube; and a mechanical arrangement for supporting the light tube so that the light tube provides support for a product to be displayed;

wherein goods to be displayed are suspended from the at least one light tube.

18. A system for displaying and illuminating goods, comprising:

at least one light tube;

an electrical connection to a source of electrical energy for illuminating the at least one light tube; and a mechanical arrangement for supporting the light tube so that the light tube provides support for a product to be displayed;

further comprising goods holders attached along the at least one light tube so that the goods are displayed.

19. A system for displaying and illuminating goods, comprising:

a plurality of light tubes;

at least one joiner for joining the light tubes end to end;

at least one electrical connection to a source of electrical energy for illuminating at least a first one of the light tubes;

at least one electrical connector for carrying electrical energy between the first one of the light tubes and a second one of the light tubes.

20. The system of claim 19, further comprising a series of joiners, light tubes and electrical connectors arranged so that the light tubes and joiners form a closed loop.

21. The system of claim 20, therein the closed loop is rectangular.

22. The system of claim 20, wherein the closed loop is triangular.

23. The system of claim 20, wherein the light tubes are curved to form part of a circle, and the closed loop is circular.

24. The system of claim 19, further comprising a series of joiners, light tubes and electrical connectors arranged so that the light tubes and joiner form a co-linear array.

25. The system of claim 19, further comprising a plurality of joiners, light tubes and electrical connectors arranged so that a first light tube is perpendicular to a second light tube.

26. The system of claim 24, wherein each of the joiners accept a cable for suspending the system, so that the system can be used to support and display goods.

* * * * *